US008663039B2

(12) United States Patent
Chiu

(10) Patent No.: US 8,663,039 B2
(45) Date of Patent: Mar. 4, 2014

(54) SPORTING BASE

(75) Inventor: Kuo-Chou Chiu, Hsinchu County (TW)

(73) Assignee: Der Shine Rubber Industrial Co., Ltd., Hsinchu County (TW)

( * ) Notice: Subject to any disclaimer, the term of this patent is extended or adjusted under 35 U.S.C. 154(b) by 42 days.

(21) Appl. No.: 13/345,831

(22) Filed: Jan. 9, 2012

(65) Prior Publication Data

US 2012/0244966 A1 Sep. 27, 2012

(30) Foreign Application Priority Data

Mar. 25, 2011 (TW) ..... 100205364 U

(51) Int. Cl.
*A63B 71/00* (2006.01)

(52) U.S. Cl.
USPC ..... 473/501; 473/499

(58) Field of Classification Search
CPC ..... A63B 69/0002; A63B 69/0013; A63B 71/0054
USPC ..... 473/501, 499, 500, 497, 451, 452
See application file for complete search history.

(56) References Cited

U.S. PATENT DOCUMENTS

| | | | | |
|---|---|---|---|---|
| 3,204,958 | A * | 9/1965 | Velasquez | 473/499 |
| 3,508,747 | A * | 4/1970 | Orsatti | 473/499 |
| 4,830,368 | A * | 5/1989 | Green et al. | 473/501 |
| 7,847,943 | B2 * | 12/2010 | Hellstrom et al. | 356/430 |

* cited by examiner

*Primary Examiner* — Mitra Aryanpour
(74) *Attorney, Agent, or Firm* — Turocy & Watson, LLP

(57) ABSTRACT

A sporting base includes a main base body, a securing seat, and a ground-insertable securing unit. The main base body includes a shock-absorbing core that has a bottom surface formed with an upwardly-extending inserting hole. The securing seat is disposed fittingly and separably into the inserting hole of the main base body, and is configured to be placed stably on the ground. The securing unit is for securing the securing seat to the ground.

10 Claims, 5 Drawing Sheets

SPORTING BASE

CROSS-REFERENCE TO RELATED APPLICATION

This application claims priority of Taiwanese Application No. 100205364, filed on Mar. 25, 2011.

BACKGROUND OF THE INVENTION

1. Field of the Invention

The invention relates to a sporting base, more particularly to a safety sporting base that can be used in standard playing fields and non-standard playing fields.

2. Description of the Related Art

As shown in FIG. 1, a conventional sporting base adapted to be used in, for example, a baseball playing field or a softball playing field, includes a main body 11 and a securing seat 12.

The main body 11 is made of a deformable and shock-absorbable material, such as rubber or high density foam material, for lowering the risk of player injury when a player slides or dives to the conventional base during a ball game. The securing seat 12 is made of metal or alloy materials for rigidity. The securing seat 12 includes a seat body 121 embedded fixedly in the main body 11 via screws, a positioning member 122 projecting downwardly and integrally from a center of the seat body 121, and an inserting rod 123 coupled removably to the positioning member 122, secured to the seat body 121 via screws and inserted removably into a connecting seat 100 which is embedded in advance in a standard playing field, thereby positioning the main body 11 on the ground. The inserting rod 123 has a length substantially equal to a depth of the inserting rod 123.

However, when the conventional sporting base is applied in a non-standard playing field without a connecting seat being disposed underground, the inserting rod 123 has to be removed by unscrewing the screws that fasten the inserting rod 123 to the seat body 121, thereby resulting in a relatively inconvenient application of the conventional sporting base. In addition, since the conventional sporting base can not be positioned on the ground without the inserting rod 123, the player may be injured when rushing to the main body 11 due to movement of the main body 11. Moreover, since the seat body 121 has a size substantially equal to that of the main body 11, when the conventional sporting base is used in a standard playing field and positioned on the ground, the player may collide directly with the rigid seat body 121 when sliding or diving to the main body 11 and be seriously injured.

SUMMARY OF THE INVENTION

Therefore, the object of the present invention is to provide a sporting base that can alleviate the abovementioned drawbacks of the prior art.

Accordingly, a sporting base of the present invention comprises a main base body, a securing seat and a ground-insertable securing unit. The main base body includes a shock-absorbing core that has a bottom surface formed with an upwardly-extending inserting hole. The securing seat is disposed fittingly and separably into the inserting hole of the main base body, and is configured to be placed stably on the ground. The securing unit is for securing the securing seat to the ground.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
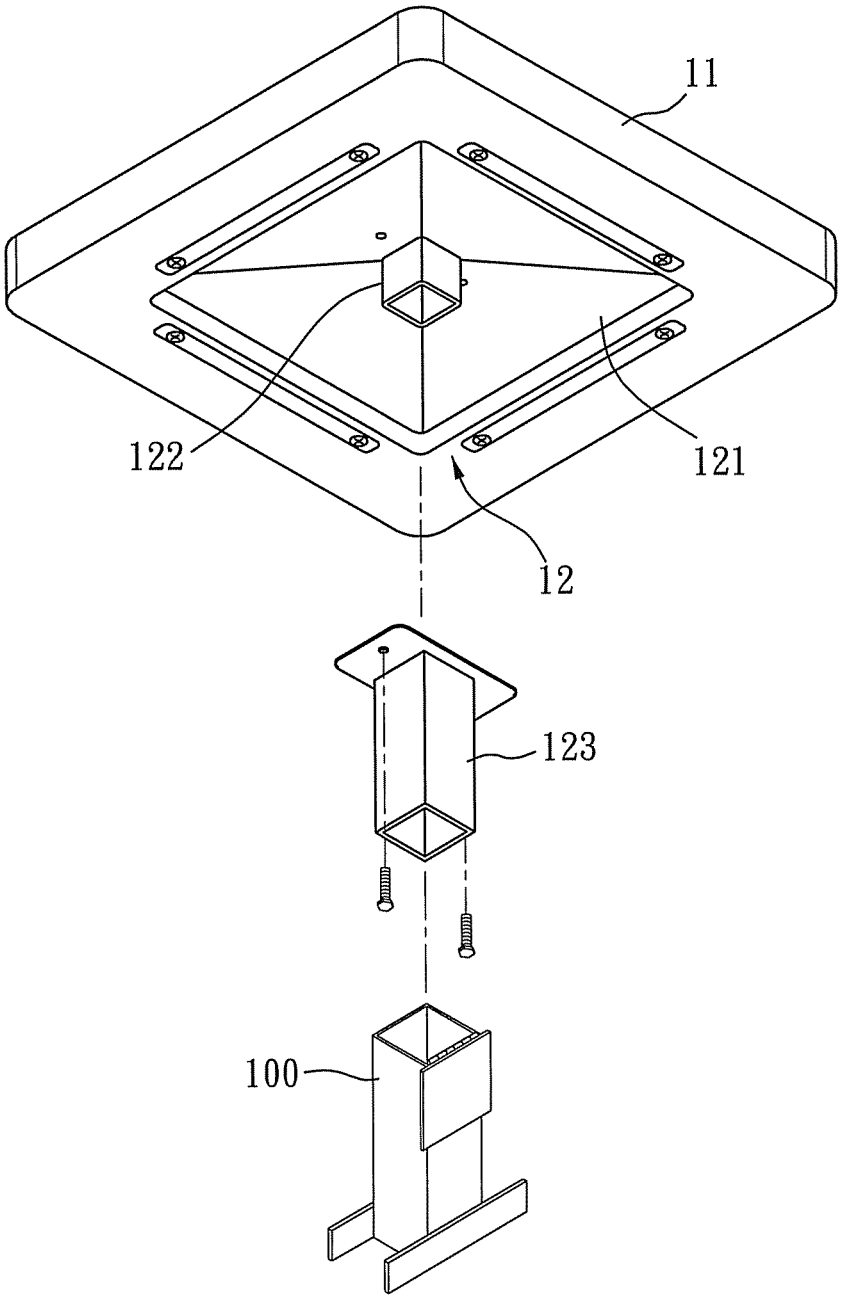
FIG. 1 PRIOR ART
FIG. 1 is an exploded perspective view of a conventional sporting base.

Before the present invention is described in greater detail, it should be noted that like elements are denoted by the same reference numerals throughout the disclosure.

Figure 2:
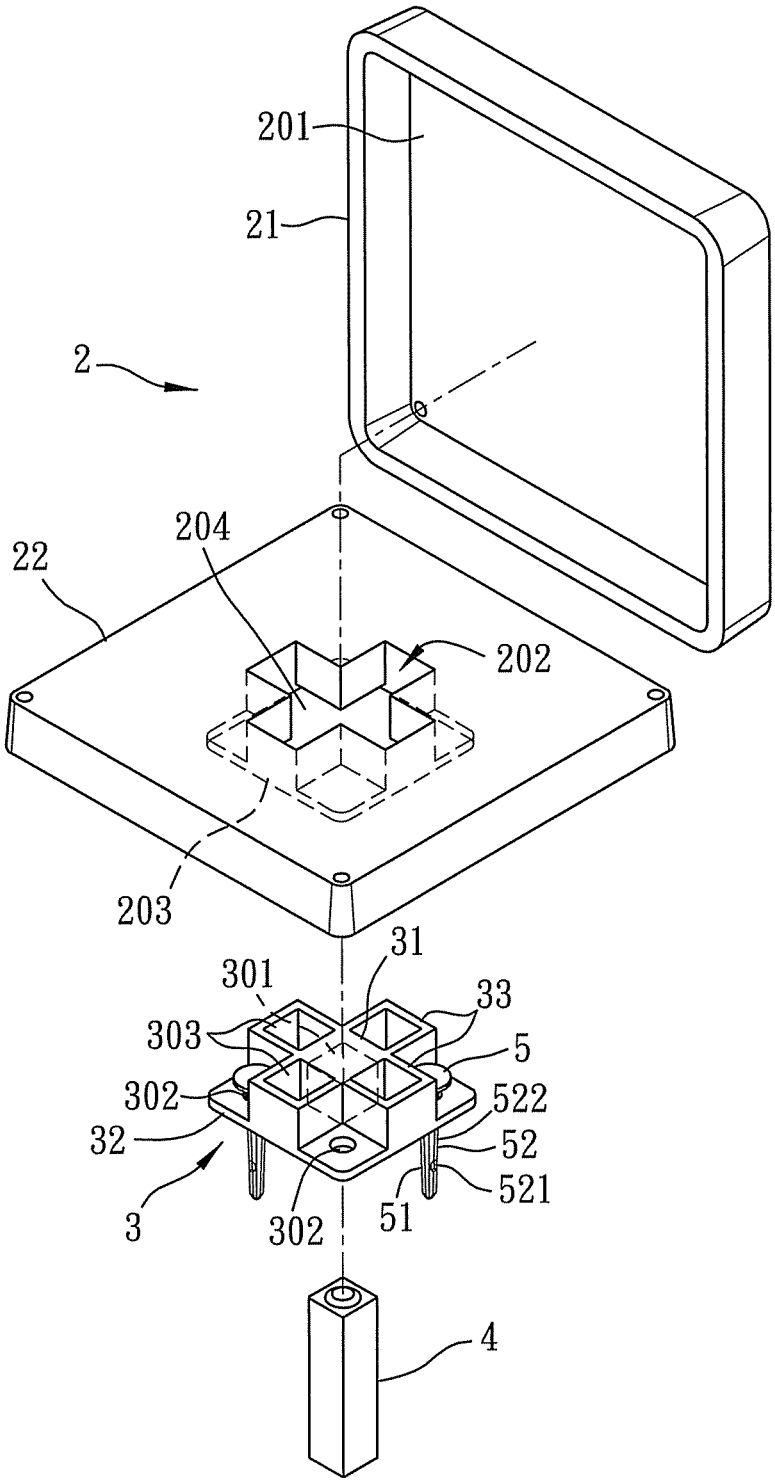
FIG. 2 is an exploded perspective view of a first preferred embodiment of a sporting base according to the invention.

As shown in FIG. 2, the first preferred embodiment of a sporting base according to the present invention comprises a main base body 2, a securing seat 3 and a securing unit.

The main base body 2 is made of a shock-absorbing material, such as rubber or high-density foam material, and includes a hollow cover 21 defining a coupling groove 201 therein, and a shock-absorbing core 22 inserted fittingly and removably in the cover 21. The shock-absorbing core 22 has a bottom surface formed with an upwardly-extending inserting hole 202. The inserting hole 202 has a small hole portion 204, and a large hole portion 203 larger than and disposed under the small hole portion 204. Preferably, the cover 21 has a hardness larger than that of the shock-absorbing core 22 so as to provide the main base body 2 with sufficient rigidity despite of the shock-absorbing ability thereof.

The securing seat 3 is made of rigid rubber instead of metal so as to have elasticity as well as rigidity, thereby providing better safety compared to the seat body 121 of the securing seat 12 of the conventional sporting base illustrated in FIG. 1. The securing seat 3 includes a surrounding wall 31 that defines an engaging hole 301 therein, a plurality of extension walls 32 that extends horizontally and outwardly from a lower end of the surrounding wall 31 and that is formed with a plurality of through holes 302, and a plurality of coupling walls 33 that are connected to the surrounding wall 31 and the extension walls 32 and that define a plurality of recesses 303. The securing seat 3 is disposed fittingly and separably into the inserting hole 202 in a manner that the surrounding wall 31 and the coupling walls 33 are in the small hole portion 204 while the extension walls 32 are in the large hole portion 203, so that the securing seat 3 can be entirely inserted within the inserting hole 202 and that the securing seat 3 can be placed stably on the ground.

The securing unit, in this embodiment, includes an engaging rod 4 that is made of metal or alloy material, and that has an upper end segment separably engageable with the engaging hole 301 of the securing seat 3. The securing unit further includes a plurality of positioning nails 5 that are extendable respectively through the through holes 302. In this embodiment, each of the positioning nails 5 has a nail body 51 extendable through a respective through hole 302, and a plurality of equiangularly spaced-apart positioning wing plates 52 formed on the nail body 51. Each of the positioning wing plates 52 has toothed edge formed with notches 521 and protrusions 522 that are disposed alternately with the notches 521.

When the sporting base of this invention is used in a standard playing field with a hollow connecting seat (not shown)

which is embedded underground, the engaging rod 4 is engaged with the engaging hole 301 of the securing seat 3, and is inserted into the connecting seat to secure the securing seat 3 to the ground. When being used in a non-standard playing field, the engaging rod 4 is removed from the securing seat 3, and the positioning nails 5 are applied to extend respectively through the through holes 302 into the ground for securing the sporting base of this invention to the ground. Therefore, the sporting base of this invention has relatively high flexibility in use.

Since the main base body 2 and the securing seat 3 are made of shock-absorbing material, and since the only part of the sporting base made of metal or alloy material, i.e., the engaging rod 4, is located mostly underground when the sporting base is in use and can hardly be accessed by a player during a game, the risk of the player being injured upon colliding with the sporting base can be reduced. Moreover, by virtue of the configuration that the cover 21 is separably coupled to the shock-absorbing core 22, that the securing seat 3 is separably coupled to the main base body 2, and that the engaging rod 4 is coupled separably to the securing seat 3, when the player rushes onto the sporting base of this invention, separation of the abovementioned elements would reduce a reaction force of the sporting base to the player, and prevent the player from being seriously injured.

Figure 3:
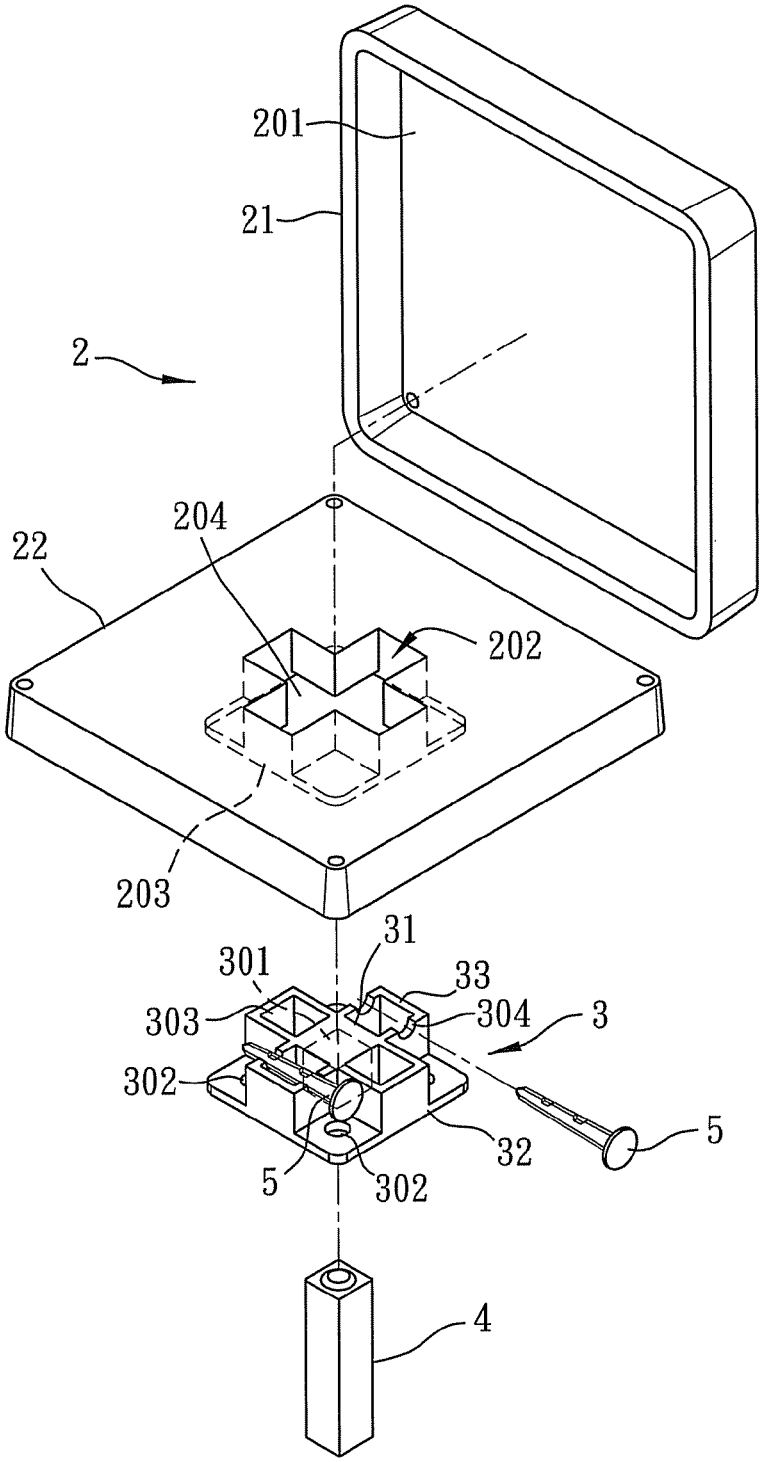
FIG. 3 is a partly exploded perspective view of a second preferred embodiment of the sporting base according to the invention.
Figure 4:
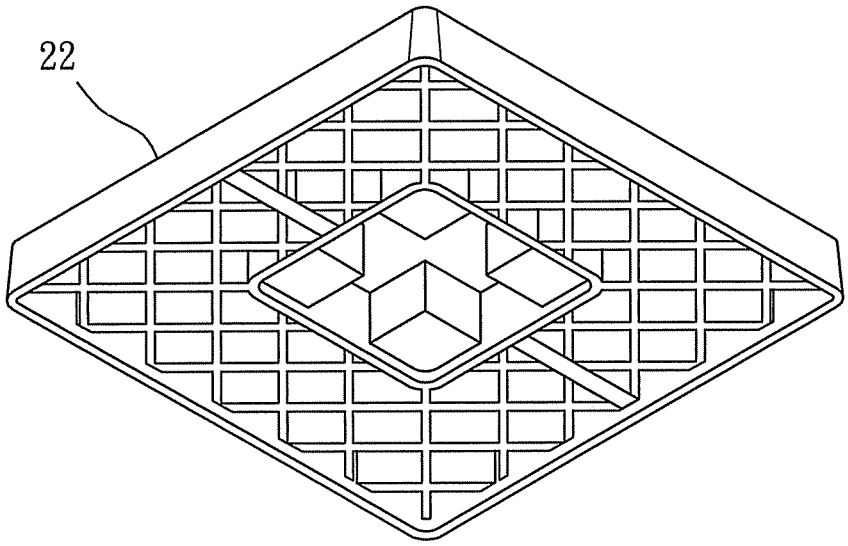
FIG. 4 is a perspective view of a shock-absorbing core of the second preferred embodiment.

As shown in FIG. 3, the second preferred embodiment of the sporting base according to the present invention has a structure similar to that of the first embodiment. The main difference between this embodiment and the previous embodiment resides in the following. In this embodiment, the coupling walls 33 of the securing seat 3 are formed with a plurality of receiving grooves 304, such that the positioning nails 5, when not being used, can be stored in the receiving grooves 304. Moreover, referring to FIG. 4, the shock-absorbing core 22 is formed at a bottom surface thereof with a plurality of grooves in grid arrangement for enhancing the structural strength against the stress force applied thereon. The second preferred embodiment has the same advantages as those of the first preferred embodiment.

Figure 5:
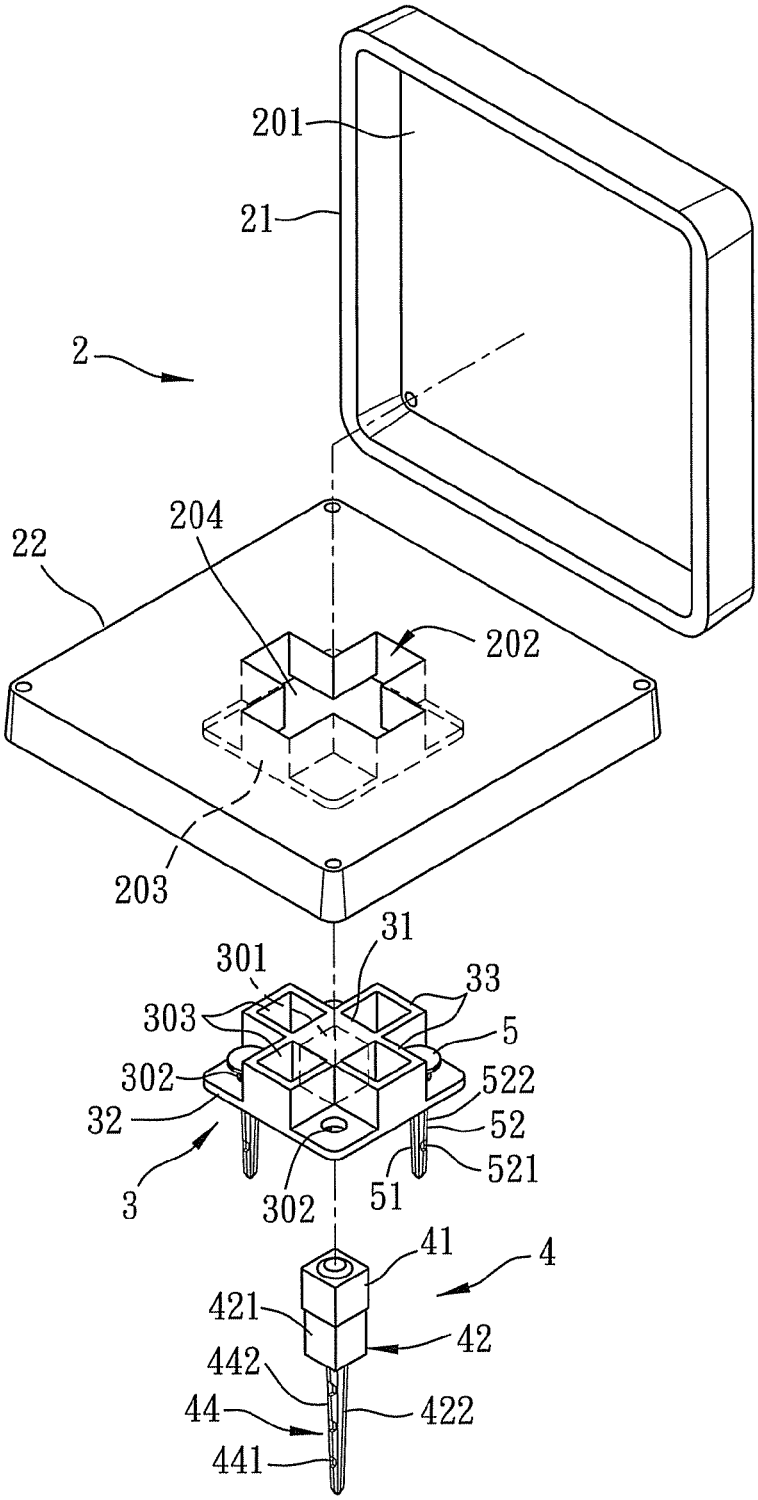
FIG. 5 is a partly exploded perspective view of a third preferred embodiment of a sporting base according to the invention.

As shown in FIG. 5, the third preferred embodiment of the sporting base according to the present invention has a structure similar to that of the first preferred embodiment. The main difference between this embodiment and the first preferred embodiment resides in the following. The engaging rod 4 has an engaging segment 41 separably engageable with the engaging hole 301 of the securing seat 3, and a positioning segment 42 extending downwardly from the engaging segment 41 and insertable into the ground for securing the sporting base of this embodiment to the ground. The positioning segment 42 has an upper section 421 connected to the engaging segment 41, and a lower section 422 extending downwardly from the upper section 421. The engaging rod 4 further has a plurality of equiangularly spaced-apart securing wing plates 44 formed on the lower section 422 of the positioning segment 42. Each of the securing wing plates 44 has a toothed edge formed with notches 441 and protrusions 442 that are disposed alternately with the notches 441.

The sporting base of this embodiment can be used in the standard playing field by inserting the engaging rod 4 into the underground connecting seat (not shown). Preferably, the positioning segment 42 is configured to have a length not less than that of the connecting seat. Since the connecting seat is generally tubular and is formed with opposite open ends, the lower section 422 of the engaging rod 4 would extend through the connecting seat and be inserted into soil under the connecting seat for further securing the securing seat 3 to the ground by virtue of the securing wing plates 44. When the sporting base of this embodiment is applied in the non-standard playing field, the securing seat 3 can be secured to the ground by inserting the engaging rod 4 directly into the ground to be secured firmly in the ground via the securing wing plates 44, or by removing the engaging rod 4 from the securing seat 3 and applying the positioning nails 5 to extend respectively through the through holes 302, or by simultaneously employing the engaging rod 4 and the positioning nails 5. The third preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A sporting base comprising:

a main base body including a shock-absorbing core that has a bottom surface formed with an upwardly-extending inserting hole;

a securing seat disposed fittingly and separably into said inserting hole of said main base body, and configured to be placed stably on the ground; and a ground-insertable securing unit for securing said securing seat to the ground;

wherein said inserting hole has a small hole portion, and a large hole portion larger than and disposed under said small hole portion; and wherein said securing seat includes a surrounding wall disposed fittingly and separably in said small hole portion, an extension wall extending outwardly from a lower end of said surrounding wall, and a plurality of coupling walls connected to said surrounding wall and said extension wall, said surrounding wall and said coupling walls being disposed fittingly and separably in said large hole portion.

2. The sporting base as claimed in claim 1, wherein:

said securing seat is further formed with at least one through hole; and said securing unit includes at least one positioning nail that is extendable through said through hole into the ground for securing said sporting base to the ground.

3. The sporting base as claimed in claim 2, wherein said positioning nail has a nail body extendable through said through hole, and at least one positioning wing plate formed on said nail body and having a toothed edge.

4. The sporting base as claimed in claim 1, wherein:

said surrounding wall of said securing seat defines an engaging hole; and said securing unit includes an engaging rod having an engaging segment separably engageable with said engaging hole of said securing seat, and a positioning segment extending downwardly from said engaging segment, and insertable into the ground for securing said sporting base to the ground.

5. The sporting base as claimed in claim 4, which is for use with a tubular connecting seat that is disposed in the ground, wherein said positioning segment is configured to be insertable into the connecting seat and has a length not less than that of the connecting seat.

6. The sporting base as claimed in claim 4, wherein said engaging rod further has a plurality of equiangularly spaced-apart securing wing plates formed on said inserting segment.

7. The sporting base as claimed in claim 6, wherein each of said securing wing plates has a toothed edge.

8. The sporting base as claimed in claim 4, wherein:

said extension wall of said securing seat is formed with at least one through hole; and said securing unit further includes at least one positioning nail that is extendable through said through hole into the ground for securing said sporting base to the ground.

9. The sporting base as claimed in claim 1, wherein said main base body further includes a cover, said shock-absorbing core being inserted fittingly and removably in said cover.

10. A sporting base comprising:

a main base body including a shock-absorbing core that has a bottom surface formed with an upwardly-extending inserting hole;

a securing seat disposed fittingly and separably into said inserting hole of said main base body, and configured to be placed stably on the ground; and a ground-insertable securing unit for securing said securing seat to the ground;

wherein said securing seat is formed with an engaging hole, said securing unit including an engaging rod that has an engaging segment separably engageable with said engaging hole of said securing seat, and a positioning segment extending downwardly from said engaging segment, and insertable into the ground for securing said sporting base to the ground;

wherein said securing seat is further formed with at least one through hole, said securing unit further including at least one positioning nail that is extendable through said through hole into the ground for securing said sporting base to the ground;

wherein said securing seat includes a surrounding wall defining said engaging hole, and an extension wall extending outwardly from said surrounding wall and formed with said through hole; and wherein said main base body is formed with a coupling groove at the center thereof, said securing seat further including a plurality of coupling walls connected to said surrounding wall and said extension wall and formed with a plurality of receiving grooves for receiving said positioning nail when said positioning nail is not in use.

* * * * *